US006540046B1

(12) United States Patent
Schuhmacher et al.

(10) Patent No.: US 6,540,046 B1
(45) Date of Patent: Apr. 1, 2003

(54) COMPACT ECONOMICAL SPARK ARRESTOR AND MUFFLER

(75) Inventors: Kory J. Schuhmacher, Oregon, WI (US); Andrew D. Aleson, Madison, WI (US)

(73) Assignee: Nelson Industries, Inc., Stoughton, WI (US)

( * ) Notice: Subject to any disclaimer, the term of this patent is extended or adjusted under 35 U.S.C. 154(b) by 0 days.

(21) Appl. No.: 09/923,080

(22) Filed: Aug. 6, 2001

(51) Int. Cl.[7] ..... F01N 3/02
(52) U.S. Cl. ..... 181/231; 181/227
(58) Field of Search ..... 181/231, 227, 181/228, 230, 240

(56) References Cited

U.S. PATENT DOCUMENTS 3,958,967 A 5/1976 Nakamura
4,370,855 A 2/1983 Tuggle
5,177,962 A 1/1993 Hall et al.
5,866,859 A 2/1999 Karisson et al.
5,969,299 A * 10/1999 Yamaguchi etal. ..... 181/227
5,996,732 A * 12/1999 Burger et al. ..... 181/230
6,164,066 A * 12/2000 Sakaguchi et al. ..... 181/231

* cited by examiner

*Primary Examiner*—Kim Lockett
(74) *Attorney, Agent, or Firm*—Andrus, Sceales, Starke & Sawall, LLP

(57) ABSTRACT

A screen-type spark arrestor (34) may be efficiently and compactly mounted in a muffler (10). A tubular screen is coaxial with an exhaust pipe (24) and has a first end (36) axially spaced from the pipe and star-crimped closed, and a second end (38) axially overlapping the pipe in concentric relation and crimped thereto by a crimp ring (40). The combination is mounted as a modular component by a flange (22) closing the muffler housing (12).

6 Claims, 3 Drawing Sheets

COMPACT ECONOMICAL SPARK ARRESTOR AND MUFFLER

BACKGROUND AND SUMMARY OF THE INVENTION

The invention relates to spark arrestors and mufflers, and more particularly to screen-type spark arrestors including within a muffler.

Conventional stator-type spark arrestors take up internal muffler volume because of the numerous components necessary to operation. For this same reason, the restriction of the muffler is increased along with the muffler cost because of the added parts.

The present invention arose during efforts to meet a need for a low cost, easily manufactured high performance spark arrestor for a variety of applications, including an ATV, all-terrain vehicle. Such product must meet USDA Standard 5100-1b for spark arrestors for internal combustion engines. This is accomplished in the present invention in a particularly desirable, simple, and low cost manner. In a particularly desirable aspect, the invention enables the use of known elements in combination, including a screen member for blocking carbon particles and preserving performance as well as keeping cost down, star-crimping, and ring crimping.

DETAILED DESCRIPTION

Figure 1:
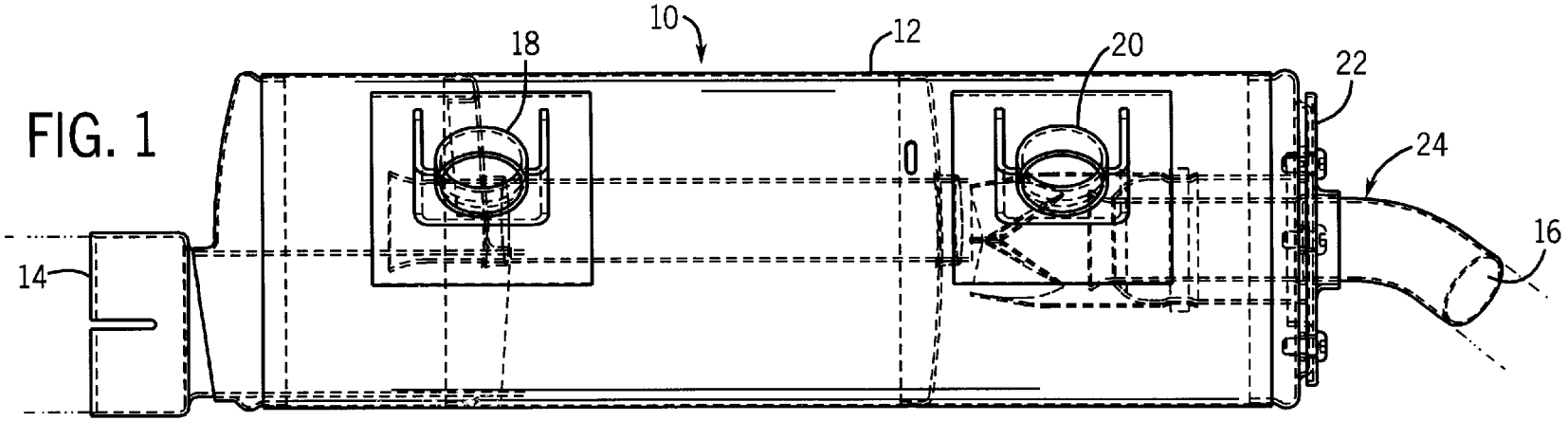
FIG. 1 is a side elevation view of a muffler in accordance with the invention.
Figure 2:
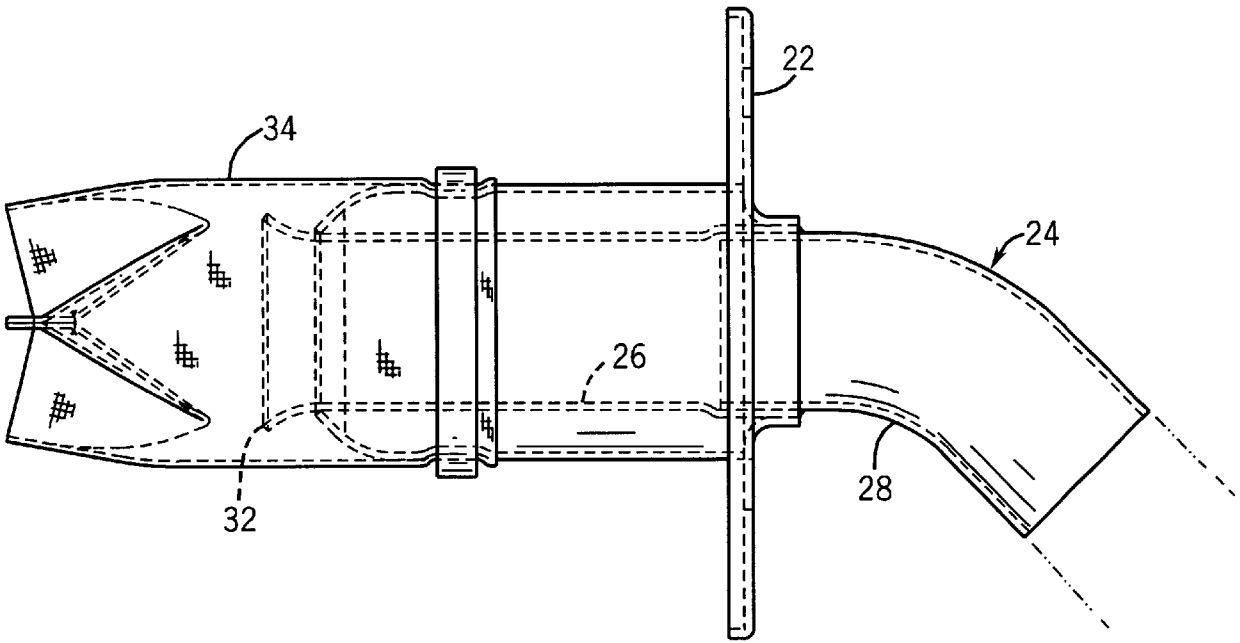
FIG. 2 is a side elevation view of one of the component parts of the muffler of FIG. 1.
Figure 4:
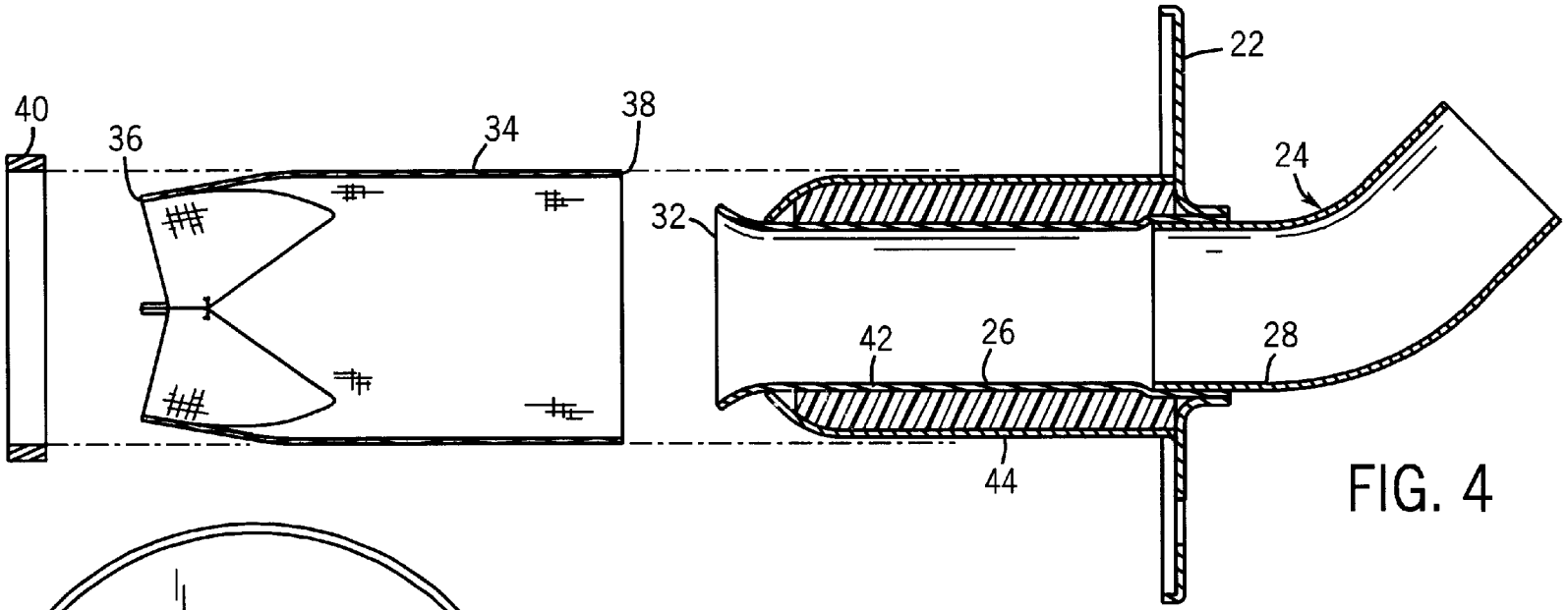
FIG. 4 is a side sectional exploded view of the component of FIG. 2.
Figure 3:
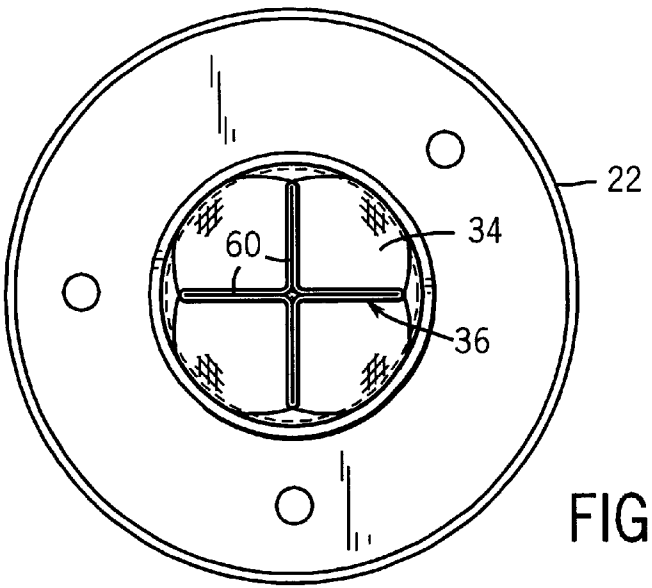
FIG. 3 is a left end elevation view of the component of FIG. 2.
Figures 5, 6, 7:
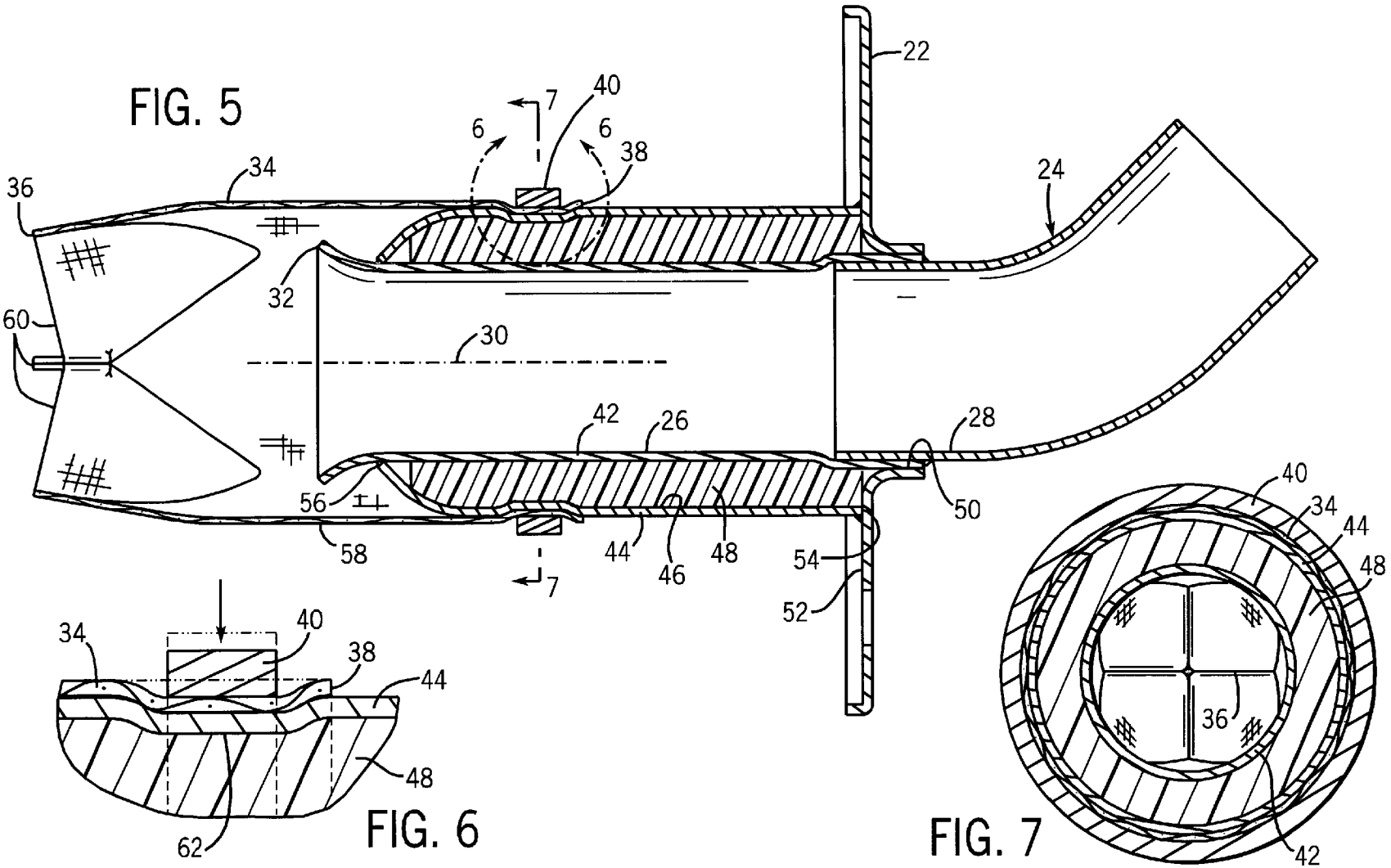
FIG. 5 is an assembled view of the structure of FIG. 4.
FIG. 6 is an enlarged view of a portion of FIG. 5 along line 6—6.
FIG. 7 is a sectional view taken along line 7—7 of FIG. 5.

FIG. 1 shows a muffler 10 having a housing 12 for silencing exhaust flowing from a housing inlet 14 to a housing outlet 16. The housing has a pair of hanger brackets 18 and 20. The muffler includes internal silencing structure His known, and does not form part of the present invention. One of the inlet and outlet, preferably the outlet, includes a flange 22 mounted to and closing the housing. The flange has an exhaust pipe 24 mounted thereto. The pipe has an interior portion 26, FIGS. 2, 4, 5, within housing 12, and an exterior portion 28 outside of the housing. Interior portion 26 of the pipe extends axially along an axis 30, FIG. 5, to an inner end 32. A tubular screen spark arrestor 34 is coaxial with interior portion 26 and extends axially along axis 30 between a first closed end 36 axially spaced inwardly from inner end 32 of the pipe, and a second distally opposite end 38 axially overlapping the pipe and extending past inner end 32 and mounted to the pipe to close end 38.

End 36 of tubular screen 34 is preferably star-crimped closed. Star-crimping is known in the prior art. End 38 of tubular screen 34 axially overlaps the outlet pipe in concentric relation and is crimped thereto by a crimp ring 40. Crimp rings are known in the prior art. Interior portion 26 of the exhaust pipe includes an inner tube 42, and an outer tube 44 spaced radially outwardly of inner tube 42 and in some embodiments forming a resonator chamber 46 therebetween filled with packing material 48. Outer tube 44 is selected from appropriate gauge metal to be deformably crimpable by crimp ring 40. Outer tube 44 extends from flange 22 inwardly into housing 12. Flange 22 has an opening 50 with an inner diameter and receiving inner tube 42. Flange 22 has an inner face 52 extending radially outwardly from opening 50 and facing into housing 12. Outer tube 44 has a first end 54 abutting and welded to inner face 52 of flange 22 and having a diameter greater than the noted inner diameter of opening 50 and spaced radially outwardly of opening 50. Portions 26 and 28 of exhaust pipe 24 are welded to each other and to flange 22 at opening 50. Outer tube 44 has a second distally opposite end 56 having a smaller diameter than the noted first end 52 of outer tube 44 and abutting inner tube 42 at an axial location between crimp ring 40 and inner end 32 of interior portion 26 of the exhaust pipe.

Screen 34 is spot welded along a seam 58 between ends 36 and 38 to maintain its tubular shape and prevent leakage. Screen 34 is also preferably spot welded at star-crimped end 36 including along the radial spokes 60 thereof, to maintain the star-crimping. Screen 34 at end 38 is initially open, FIG. 4, and is axially slidable along the exhaust pipe and is closed and mounted thereto only by crimp ring 40, without welding.

The present invention in combination enables a screen-type spark arrestor to be placed over the exhaust tube to block carbon particles, and preserve performance as well as reducing cost. The use of the star-crimp construction and the crimp ring keeps the cost down and the performance up. The construction allows the use of screen material chosen to meet the noted USDA Standard 5100-1b, namely that the screen have a plurality of openings having a cumulative area greater than 200% of the radial cross-sectional area of the exhaust pipe. The crimp ring 40 is desirable to attach the screen to the exhaust pipe since a conventional weld or spot-weld is not easily manufacturable. The crimping down of the ring, FIG. 6, to a smaller diameter at area 62 eliminates the need for welds while simplifying the construction and increasing productivity and reducing cost.

It is recognized that various equivalents, alternatives and modifications are possible within the scope of the appended claims.

What is claimed is:

1. A muffler comprising a housing for silencing exhaust flowing from a housing inlet to a housing outlet, one of said inlet and outlet comprising a flange mounted to and closing said housing, said flange having an exhaust pipe mounted thereto, said pipe having an interior portion within said housing, and an exterior portion outside of said housing, said interior portion of said pipe extending axially along an axis to an inner end and having a tubular screen spark arrestor coaxial therewith and extending axially along said axis between a first closed end axially spaced inwardly from said inner end of said pipe, and a second distally opposite end axially overlapping said pipe and extending past said inner end of said pipe and mounted thereto to close said second end of said tubular screen, wherein said second end of said tubular screen axially overlaps said pipe in concentric relation, said second end of said tubular screen is crimped to said pipe by a crimp ring, said interior portion of said pipe comprises an inner tube, and an outer tube spaced radially outwardly of said inner tube, said outer tube being deformably crimpable and extending from said flange inwardly into said housing, said flange an opening with an inner diameter and receiving said inner tube, said flange having an inner face extending radially outwardly from said opening and facing into said housing, said outer tube having a first end abutting said inner face of said flange and having a diameter greater than said inner diameter and spaced radially outwardly of said opening.

2. The muffler according to claim 1 wherein said outer tube has a second distally opposite end having a smaller diameter than said first end of said outer tube and abutting said inner tube at an axial location between said crimp ring and said inner end of said interior portion of said pipe.

3. A spark arrestor for an exhaust pipe extending axially along an axis, comprising in combination a tubular screen coaxial with said pipe and having a first end axially spaced from said pipe and star-crimped closed, and having a second distally opposite end axially overlapping said pipe in concentric relation and crimped thereto by a crimp ring.

4. The spark arrestor according to claim 3 wherein:

said screen is welded along a seam between said first and second ends to maintain its tubular shape and prevent leakage;

said screen is welded at said first star-crimped end;

said screen at said second end is initially open and axially slidable along said pipe and is closed and mounted thereto only by said crimp ring, without welding.

5. The spark arrestor according to claim 3 wherein said screen has a plurality of openings having a cumulative area greater than 200% of the radial cross-sectional area of said pipe.

6. A method for making a muffler comprising providing a housing for silencing exhaust flowing from a housing inlet to a housing outlet, providing a flange mountable to said housing at one of said inlet and said outlet, mounting an exhaust pipe to said flange such that said pipe has an interior portion for extending within said housing, and an exterior portion for extending outside of said housing, providing said interior portion of said pipe extending axially along an axis to an inner end, providing a tubular screen spark arrestor for extending axially along an axis between a first closed end and a second distally opposite open end, coaxially aligning said spark arrestor with said interior portion of said pipe and axially sliding said spark arrestor along said interior portion of said pipe such that said second end of said tubular screen axially overlaps said pipe and extends past said inner end of said pipe and such that said first end of said tubular screen is axially spaced from said inner end of said pipe, and mounting said tubular screen to said pipe to close said second end of said tubular screen, axially sliding a crimp ring along said tubular screen to an axial position between said inner end of said pipe and said second end of said tubular screen, and crimping said screen to said pipe with said crimp ring, and providing said interior portion of said pipe with an inner tube, and outer tube spaced radially outwardly of said inner tube, providing said outer tube as deformably crimpable and extending from said flange inwardly into said housing, providing said flange with an opening having an inner diameter and receiving said inner tube, providing said flange with an inner face extending radially outwardly from said opening and facing into said housing, providing said outer tube with a first end abutting said inner face of said flange and having a given diameter greater than said inner diameter and spaced radially outwardly of said opening, and crimping said outer tube with said crimp ring at said tubular screen to a diameter less than said given diameter.

* * * * *